US005239898A

United States Patent [19]

Douglas

[11] Patent Number: 5,239,898

[45] Date of Patent: Aug. 31, 1993

[54] ADJUSTABLE WRENCH MECHANISM

[76] Inventor: Ormond S. Douglas, c/o P.O. Box 1085, Dayton, Tex. 77535

[21] Appl. No.: 952,971

[22] Filed: Sep. 29, 1992

[51] Int. Cl.[5] ..... B25B 13/14

[52] U.S. Cl. ..... 81/165; 81/170

[58] Field of Search ..... 81/165, 168–170, 81/129, 129.5, 142, 144, 145, 148, 149, 154

[56] References Cited

U.S. PATENT DOCUMENTS 1,411,135 3/1922 Thompson ..... 81/170

1,936,812 11/1933 Welling ..... 81/165

*Primary Examiner*—D. S. Meislin

*Attorney, Agent, or Firm*—James L. Jackson

[57] ABSTRACT

An adjustable wrench mechanism is provided which has the capability of imparting significant clamping force to the movable jaw of the wrench mechanism. An elongate worm gear rotatably positioned within the handle structure of the wrench is manually rotatable to impart linear motion to an elongate drive rod within a drive rod passage of the wrench handle. To the drive rod is coupled a flexible elongate chain-like drive section capable of transitioning from the drive passage to an angularly oriented keyway and in such manner so as to engage within a drive receptacle of the key structure and impart significant driving force to the drive section of the key structure of the movable jaw. Fixed and movable jaws of the wrench mechanism define flat working surfaces that are slightly out of parallel and become precisely parallel as the tolerances of the movable jaw key and keyway are taken up by application of manual force. The elongate flexible drive section may incorporate a plurality of spherical or washer type drive elements which are threaded onto an elongate flexible drive cable and secured thereto by means of a terminal connector.

15 Claims, 2 Drawing Sheets

FIG.4
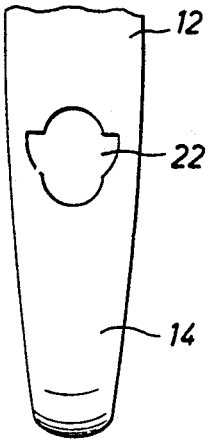
FIG.5
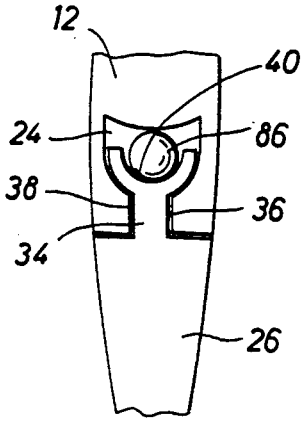
FIG.6
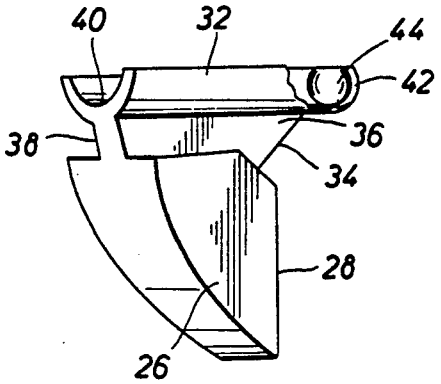
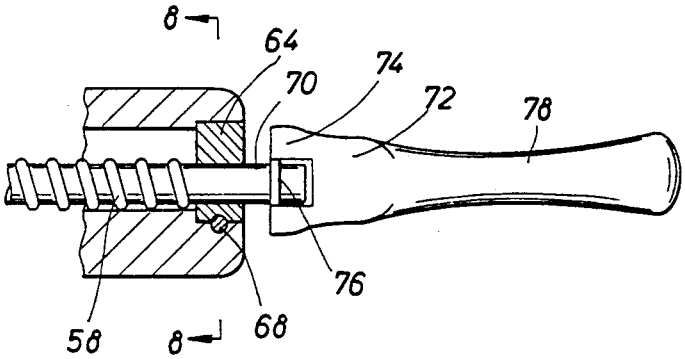
FIG.8
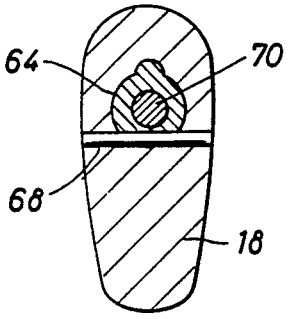
FIG.7
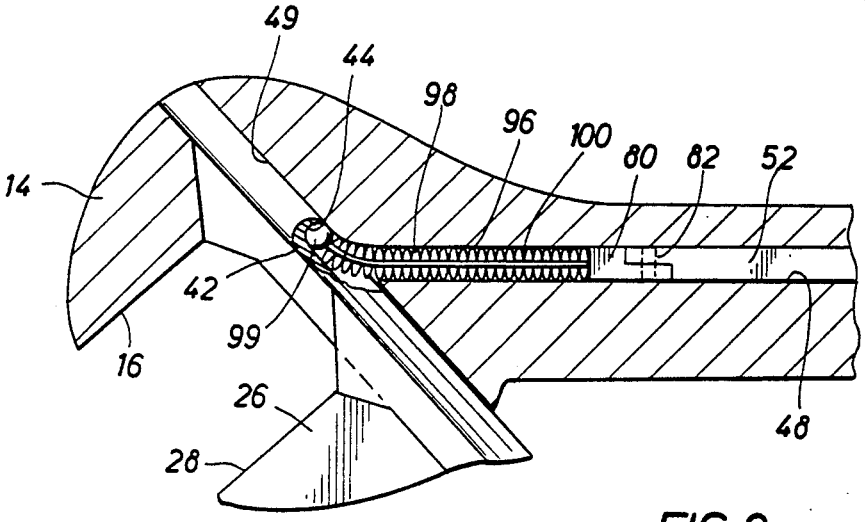
FIG.9

ADJUSTABLE WRENCH MECHANISM

FIELD OF THE INVENTION

This invention relates generally to adjustable wrench mechanisms and more particularly concerns an adjustable wrench mechanism having a wrench head to which is assembled a movable jaw and wherein the wrench mechanism incorporates a gear driven linearly movable drive rod having a flexible extremity disposed in driving engagement with the movable jaw and having the capability of driving the movable jaw with sufficient mechanical advantage so as to accomplish tight clamping of an object such as a nut, bolt, or other flat sided object.

BACKGROUND OF THE INVENTION

Adjustable wrenches having a head to which is attached a handle structure and incorporating a jaw structure that is disposed in movable, guided relation with the wrench head and is adjustable to accommodate different sizes of nuts, bolts and other flat sided objects are widely used in the industry. Although many different types of adjustable wrenches have been developed over the years, the most prevalent adjustable wrench being marketed at the present time is of the type incorporating a rotary worm gear in the wrench head structure which is disposed in driving relation with gear teeth that are provided on the movable jaw. Although these types of adjustable wrenches are quite well known, they have a number of disadvantages.

With the rotary worm gear drive located in the head structure of the wrench, it is necessary that the user accomplish rotation of the worm gear drive by rotating it with the thumb or finger while holding the wrench structure at or near the head portion thereof. If the nut or bolt to be rotated is located in an area that is accessible only by holding the handle portion of the wrench, then adjustment of the wrench jaw in this circumstance is typically accomplished by trial and error. Thus, it may take several trials and adjustments to properly position the movable jaw to rather tightly receive the opposed flat surface of a nut or bolt therebetween. Further, worm gear drive type adjustable wrenches are typically manufactured with quite wide tolerances in order to minimize the cost thereof. These wide tolerances typically permit the worm gear to have some degree of rotation while the wrench is being used. It is not unusual for movable jaw will spread from the fixed jaw of the head during use of the wrench, thereby requiring further adjustment in order to complete the task. Further, these wide tolerances of manufacture allow the wrench jaws to spread somewhat when force is applied by manual rotation of the wrench handle.

Even through the movable jaw of a conventional adjustable wrench may be properly adjusted for a close fit with the opposed flats of a nut or bolt, when force is applied upon manual rotation of the wrench handle about the nut or bolt, it is typical for the movable jaw to have some spreading movement due to the manufacturing tolerances of the jaw drive mechanism. When this occurs, engagement of the flat surfaces on the movable and fixed jaws of the wrench will often contact the nut or bolt head at or near the corners thereof such that a large force is applied to a very limited structural area of the nut or bolt. In this case, it is not unusual for the corners of the nut or bolt to become rounded as the structural integrity of the metal thereof is exceeded.

Accordingly, it is desirable to provide an adjustable wrench mechanism that will have virtually no jaw movement upon application of manual force so that the nut, bolt or other object will be properly gripped between the flat surfaces of the movable and fixed jaws.

Also, it is desirable to provide an adjustable wrench mechanism that can be adjusted by manipulation of an adjustment mechanism provided at the end portion of the handle structure so that the jaw structure of the wrench may be properly adjusted to fit a remotely located nut or bolt without having to employ the typical trial and error approach that is ordinarily used.

Most wrenches are simply adjusted to the size of the nut or bolt to be rotated and do not provide any griping function at all. It is desirable to provide an adjustable wrench mechanism that has the capability of providing a tight gripping force on the nut, bolt, or other object. This feature would enable the wrench to also be employed as a clamping device to secure parts in temporary assembly. Further, even though a mechanism is employed to accomplish light gripping of a nut or bolt, it is desirable to ensure that the wrench mechanism is easily operable to release its tight gripping.

THE PRIOR ART

As mentioned above, various adjustable wrench mechanisms have been developed to provide the capability for using a single wrench to accomplish rotation of various sizes of nuts or bolts. Exemplary of adjustable wrench development are the adjustable wrench designs set forth in U.S. Pat. No. 784,243 of Whaley; U.S. Pat. No. 1,643,633 of Vaneck; U.S. Pat. No. 1,551,085 of Carpenter; U.S. Pat. No. 2,797,600 of Beaver; and, U.S. Pat. No. 3,892,150 of Horton. It should be noted that the adjustable wrench of the '243 Patent of Whaley incorporates a rotary adjustment shaft that extends through the handle structure of the wrench and carries a knurled rotary finger piece "F" which is fixed to the rotary shaft by means of a pin. When this finger piece is rotated, a worm gear at the inner extremity of the shaft is also rotated and drives a rack and pinion mechanism for achieving adjustment of the movable jaw. This type of wrench will have considerable jaw movement upon use because of the considerable mechanical play that must be compensated for in the worm gear, pinon gear, rack gear connection that is utilized for accomplishing movement of the jaw. The adjustable wrench mechanism of U.S. Pat. No. 3,892,150 of Horton discloses a self-adjusting open or closed end type ratchet wrench which, as shown in FIG. 18, utilizes a drive mechanism which extends through the handle structure of the wrench. A linearly movable actuator shaft is not employed by any of the above noted prior art patents to accomplish movement of the jaw of the wrench.

SUMMARY OF THE INVENTION

It is a principle feature of the present invention to provide a novel adjustable wrench mechanism which has the capability of tightly engaging the opposed flat surfaces of a nut, bolt or other object to thereby permit considerable manual force to be applied to the nut or bolt without exceeding its structural integrity and causing deformation thereof.

It is also a feature of this invention to provide a novel adjustable wrench mechanism having the capability of easily and quickly being adjusted to precisely fit a remotely located nut, bolt or other object without requiring trial and error adjustment thereof.

It is also a feature of this invention to provide a novel adjustable wrench mechanism incorporating a linear drive mechanism within the handle and head structure thereof which is adapted to impart considerable driving force to the movable jaw to thereby achieve clamping of a nut, bolt or other flat sided object between the flat jaw surfaces thereof.

It is also a feature of this invention to provide a novel adjustable wrench mechanism which is simply and efficiently releasable from its tight clamp-like gripping of a nut, bolt or other object without any necessity for applying significant releasing force.

It is an even further feature of this invention to provide a novel adjustment structure including a manipulable pivotal operating handle located at the extremity of the wrench handle and which permits application of significant rotary force for manipulation or driving of the movable jaw into properly adjusted, tight engagement with the nut bolt or other object that is intended.

Briefly, the various features of the present invention are realized through the provision of a wrench mechanism incorporating a head structure having integral therewith a fixed jaw structure and an operating handle. The fixed jaw structure forms a flat working surface which is positioned at an angle of substantially 90° with respect to an internal jaw track or keyway that is defined by the wrench head structure. A movable jaw which is provided with a guide track engaging key is disposed in movable, guided relation with respect to the fixed jaw of the head structure. The movable jaw defines a flat working surface that is positioned in substantially parallel position with the flat working surface of the fixed jaw. The flat working surface of the movable jaw is typically disposed in slight angular relation with the working surface of the fixed jaw so that the working surfaces of the fixed and movable jaw become precisely parallel when rotational force is being applied through the wrench structure to an object such as a nut or bolt for rotation thereof.

Within the handle structure of the wrench is provided an elongate, generally straight passage which is disposed in intersecting relation with the guide track of the wrench head. Within this passage is located an elongate generally straight drive rod which is linearly movable within the handle structure by means of a worm gear drive mechanism having a pivotal drive operating handle extending beyond the end of the wrench handle and adapted for manual rotation so that the elongate drive rod can be driven with considerable linear force. The drive rod, at the end thereof opposite the worm gear drive mechanism, incorporates a flexible extremity which is guided by the wall structure of the passage and by the wall structure of the keyway. The free extremity of the flexible drive section of the drive rod is disposed in driving engagement with a drive receptacle that is provided on the movable jaw in the region of the guide key thereof. The flexible drive section is a chain-like structure having a plurality of small rigid drive elements such as spheres, platelets, etc. which are secured in side-by-side relation by a flexible drive cable which extends through holes in the drive elements. The endmost rigid drive element is interlocked within the receptacle of the movable jaw and, as such, when pushed or pulled it causes movement of the movable jaw. To insure that the flexible drive portion of the drive rod does not yield rearwardly as the movable jaw receives the resistance force of a nut, bolt or other object, the wrench head may be provided with a compression support which resists compression induced movement of the section into the guide track as spreading force is induced to the jaws of the wrench. This insures that the movable jaw is driven firmly against the nut, bolt or other object with a degree of clamping force that is desired. In fact, the jaw drive mechanism of this adjustable wrench can become so tightly clamped to an object that the clamp connection will support a weight of several hundred pounds. Yet the wrench is easily opened simply by counter rotating the operating handle to release the force of the drive rod and flexible drive section on the movable jaw.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
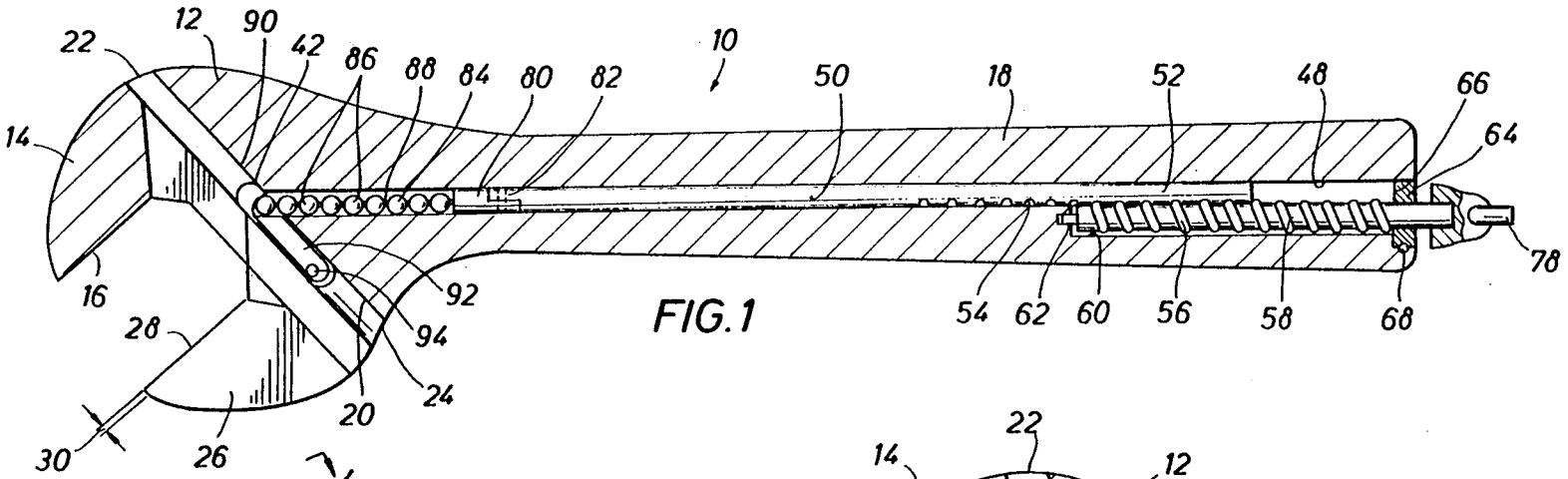

FIG. 1 is a sectional view of an adjustable wrench mechanism that is constructed in accordance with the present invention.

Figure 2:
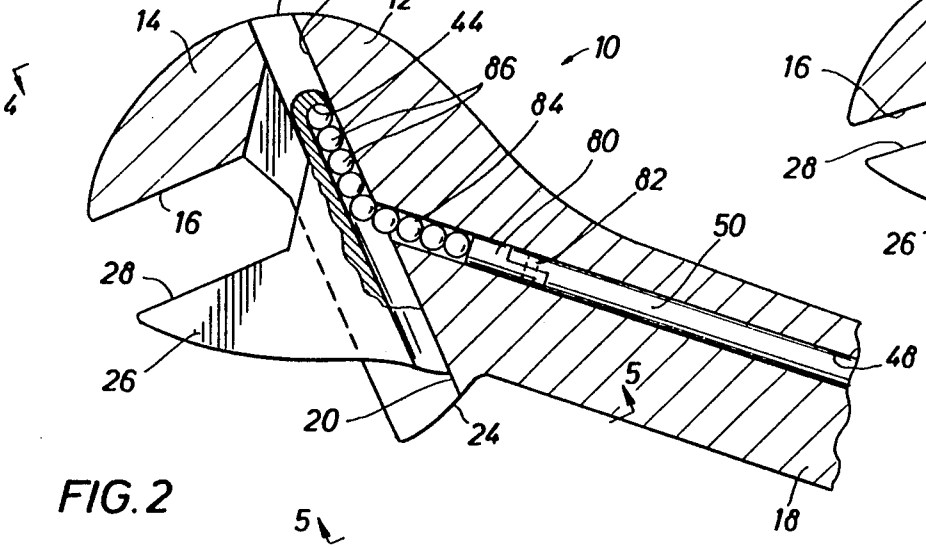

FIG. 2 is a partial sectional view similar to that of FIG. 1 and showing the movable jaw structure being located at an intermediate position.

Figure 3:
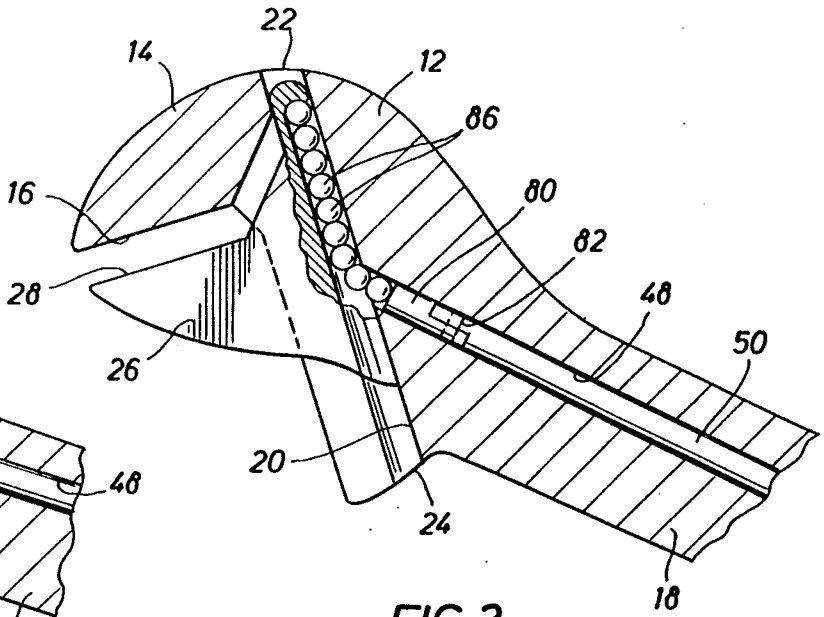

FIG. 3 is a partial sectional view similar to that of FIG. 2 and showing the movable jaw of the wrench mechanism at a nearly closed position.

FIG. 4 is a fragmentary elevational view taken from the top portion of the wrench head along line 4—4 and showing the configuration of the keyway thereof.

FIG. 5 is a partial elevational view taken along line 5—5 of FIG. 2 and illustrating the configuration of the key of the movable jaw and the keyway of the wrench head.

FIG. 6 is an isometric illustration of the movable jaw structure of the wrench mechanism showing the guide key and drive projection structures thereof.

FIG. 7 is a sectional view of the end of the handle structure of the wrench mechanism illustrating the bushing support and toggle actuating assembly of the rotary worm drive gear drive shaft.

FIG. 8 is a sectional view taken along line 8—8 of FIG. 7.

FIG. 9 is a partial sectional view showing an adjustable wrench mechanism representing an alternative embodiment of this invention.

DETAILED DESCRIPTION OF THE PREFERRED EMBODIMENT

Referring now to the drawings and first to FIGS. 1-5, an adjustable wrench mechanism constructed in accordance with the present invention is illustrated generally at 10 which incorporates a wrench head structure 12 having a fixed jaw structure 14 defining a flat working face 16. To the wrench head structure 12 is integrally connected a handle structure 18 which is of a configuration for comfortable gripping by a hand of the user. Interiorly of the head structure 12 is defined a jaw guide track or keyway 20 which intersects the top and bottom portions of the hinge structure at keyway openings 22 and 24 respectively. The configuration of these keyway openings is evident from the partial elevational view of FIGS. 4 and 5 respectively. These particular keyway configurations, however, are not intended to limit the spirit and scope of the present invention, being merely representative of the preferred embodiment.

As shown in FIG. 1, and particularly in the isometric illustration of FIG. 6, the adjustable wrench mechanism is provided with a movable jaw 26 defining a flat working surface 28 which is disposed in slightly angulated relation with respect to the flat working surface 16 of the fixed jaw 14. This slight angular relation, which may be in the order of from ½° to 2° is illustrated at 30 in FIG. 1. After the working surfaces 16 and 28 have been urged into tight engagement with opposed flat surfaces of a nut, bolt, or other object manual force is applied to the wrench handle 18 to impart rotation to the nut or bolt. As reasonably high resistance is encountered, such as during tightening or initial loosening of a nut or bolt, the slight angular relation established by working surface 28 relative to the working surface 16 will be accommodated by takeup of the internal manufacturing tolerances of the wrench mechanism. When reasonably high force is applied therefor, the working surfaces 16 and 28 will become precisely parallel by virtue of the tolerance takeup by the movable jaw 26 and thus will establish complete face-to-face engagement with the opposed flats of the object being engaged. If tight gripping or clamping force is applied to the wrench jaws this force will induce tolerance takeup, causing the working surfaces to become precisely parallel.

As is also more clearly illustrated in the isometric view of FIG. 6, the movable jaw 26 is provided with an elongate key structure 32 having a relatively thick guide web 34 defining opposed, parallel web surfaces 36 and 38. The key 34 of the movable jaw 26 is also provided with an elongate keyway having a half-moon like cross-sectional configuration forming an elongate generally straight trough 40. One end of the elongate trough 40 is closed by means of a jaw drive section 42 forming an internal receptacle 44 which may be of partially spherical configuration if desired. The partially spherical receptacle 44 is adapted to receive in locking engagement the first rigid drive element of a flexible end of a drive bar as will be discussed in detail hereinbelow.

The handle structure 18 of the wrench mechanism is machined or otherwise formed to define an elongate internal drive passage 48 which is preferably of non-circular configuration but which may conveniently take the form of a drilled cylindrical bore if desired. Within the passage 48 is positioned an elongate, substantially straight, preferably noncircular drive rod 50 having a rear end portion 52 defining a threaded section 54, preferably acme type threads, of a character adapted to receive the worm gear threads 56 of an elongate rotary worm gear 58 which is rotatably positioned within an offset worm gear passage 60. Though the drive passage 48 may be entirely disposed within the wrench handle as shown, it may be defined by a plurality of guide sections or guide bushings that, guide linear movement of the drive rod. Though it is preferable that the drive rod not rotate within its passage, some rotary rod movement may be acceptable. The worm gear 58 is supported at one end for rotation by means of an axially oriented spindle 62 and is supported at the opposite end by means of a bushing 64 that is secured in position within a depression 66 by means of a locking pin 68. The worm gear support bushing 64 and its locking pin 68 are also shown in sectional view of FIG. 8. The worm gear 58 defines a gear shaft 70 which extends beyond the support bushing 64 as shown in FIG. 7 and is provided with a pivotal gear actuator link 72 which defines a bifurcated portion 74 which is pivotally connected to the shaft 70 by means of a pivot pin 76. An operator arm 78 extends beyond the free end of the toggle link 72 and provides mechanical advantage for achieving selective forcible rotation of the worm gear shaft 70.

If desired, the worm gear may be simply supported for rotation by the wall of the passage 60 within which it is rotatable so as to eliminate the necessity for a support busing and spindle. As the worm gear 58 is rotated by manual manipulation of the toggle link 72 and its actuator arm 78, the worm gear imparts linear motion to the elongate drive shaft 50 within the drive passage 48. At the opposite end of the drive bar 50 from the worm gear threads 54, preferably acme type threads, the drive bar is provided with a coupling 80 which is connected thereto by means of a coupling pin 82. From the coupling extends an elongate, flexible drive section 84 which, in the case shown in FIGS. 1–3, is formed by a plurality of generally spherical rigid drive elements 86. A drive cable 88 extends through holes in the rigid drive elements. When the drive rod is moved linearly and places the flexible drive section in compression, the rigid elements of the flexible drive section collectively transmit the drive rod force to the movable jaw of the wrench. The terminal end of the flexible drive cable 88 is restrained within the internal receptacle or drive recess by the wall structure of the guide track. With the initial spherical drive member located within the recess or receptacle 44 defined by the drive projection 42, as the initial spherical drive member is forced toward the drive projection it applies force to the drive projection causing the movable jaw 26 to move such that working surface 28 thereof moves toward the working surface 16 of the fixed jaw 14. The rigid drive elements of the flexible drive section are maintained in driving alignment, when in compression, by the wall surfaces of the rod guide passage 48 and by guide surfaces of the guide track including surface 49. As the movable jaw 26 encounters the resistance of a nut, bolt or other object, under certain conditions there may be a tendency for the flexible drive section 84 to flex downwardly as shown in FIG. 1 so as to yield into the keyway 20 toward the keyway opening 24. To prevent this occurrence, there may be provided within the head structure of the wrench, a compression element 92 which is secured in place by one or more connector pins 94. The compression element 92 is positioned so as not to interfere with movement of the key portion of the movable jaw, but in position to restrain and guide the spherical drive elements 86 of the flexible drive section 84. Thus, as the drive rod 50 is moved linearly toward the wrench head 12 the flexible drive section 84 will traverse the keyway in such manner so as to apply force to the drive projection 42 of the movable jaw 26. This movement can continue as evidenced by the relative positions of the components as shown in FIGS. 1, 2 and 3 as the movable jaw moves toward its fully closed position. It should be noted that the wrench structure of FIGS. 2 an 3 do not incorporate a compression member such as shown in FIG. 1.

After the opposed flat surfaces of a nut or bolt or other object are engaged by the working surfaces 16 and 28, it may be desirable to apply a clamping force to the object being engaged by the working surfaces. To accomplish this the actuator handle or arm 72 of the rotary worm gear shaft 58 are rotated thus causing the worm gear to impart a significant driving force to the elongate drive rod 50. This causes the flexible drive section 84 to impart a greater force to the drive projection 42 and to the movable jaw 26. Through manipulation of the worm gear drive mechanism a sufficient clamping force may be induced between the working surfaces 16 and 28 that the nut, bolt or other object being clamped will be supported with significant clamping force. For example a nut may be clamped with sufficient force that the nut will support a weight of several hundred pounds. This type of clamping capability is not available in any other adjustable wrench mechanism known to the inventor. This high magnitude clamping force is easily released simply by counterrotating the actuator handle 78, which releases the driving force applied to the movable jaw by the drive rod 52 and the flexible drive section 84 or 96.

As shown in the alternative embodiment of FIG. 9, an adjustable wrench mechanism that is substantially identical with the structure of FIG. 1 may incorporate a drive rod and coupling assembly as shown at 52, 80, 82 which provides for connection of an elongate flexible drive section 96 which is composed of a plurality of washer like members each having thin outer peripheries and rather thick intermediate sections. These washers 98 have holes centrally thereof through which is threaded an elongate drive cable 100. The driving terminus of flexible drive section 96 is formed by a spherical incompressible drive member 99 which is received in driving engagement within the drive receptacle 44 in the same manner as discussed above in connection with FIGS. 1-3. As the drive washers or wafers 98 negotiate the transition between the straight passage section to the keyway, the thin outer peripheries of the drive washers can come close together as shown in FIG. 9, thereby allowing the flexible drive section to readily negotiate this transition. The initial drive member of the flexible drive member 96 will enter the drive depression or receptacle within the drive projection 42 and will be maintained in driving connection therewith by the wall surfaces of the guide track in the manner discussed above in connection with FIG. 1. The drive receptacle of the closed section 42 may not need to be of spherical configuration, but may take any other suitable configuration as desired.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. An adjustable wrench mechanism, comprising:

(a) an elongate wrench body structure having a head at one end thereof to which is integrally connected an elongate handle and a fixed jaw, said fixed jaw having a flat working surface thereon, said head defining an internal passage therethrough forming a guide track, said elongate handle defining a substantially straight elongate internal passage having angular intersection with said guide track, said elongate handle further defining an offset internal passage disposed in communication along the length thereof with said substantially straight elongate internal passage;

(b) a movable jaw having a guide key portion thereof being disposed in linearly movable relation with said guide track, said movable jaw having a flat working surface thereon for cooperating with said flat working surface of said head to define opposed spaced flat working surfaces for driving engagement with nut and bolt heads and other objects having opposed flat surfaces thereon;

(c) an elongate flexible jaw drive element being disposed in linearly movable guided relation within said substantially straight elongate internal passage of said handle and having a driving extremity thereof disposed in driving engagement with said movable jaw for achieving positioning of said movable jaw relative to said fixed jaw of said head, said elongate flexible drive element being defined by a plurality of rigid drive segments disposed in side-by-side relation and each defining an opening centrally therethrough;

(d) an elongate drive rod being supported for linear, non-rotatable movement within said substantially straight elongate passage of said handle, said elongate drive rod defining a forward end and a rear end, said rear end of said elongate drive rod having gear teeth along one side thereof;

(e) a flexible drive cable extending through said central openings of each of said rigid drive segments and having one end fixed to the first of said drive segments and having the other end thereof immovably connected to said elongate drive rod;

(f) a work gear being mounted for rotation within said offset internal passage and having geared driving interconnection with said gear teeth of said elongate drive rod; and (g) an actuator element being connected in driving relation with said worm gear and being manually actuatable for imparting forcible linear driving movement to said elongate flexible jaw drive means and thus imparting adjusting and clamping movement of said movable jaw relative to said fixed jaw.

2. The adjustable wrench mechanism of claim 1, wherein:

(a) said guide track of said head being disposed in obtuse angular relation with respect to said drive rod guide; and (b) said elongate flexible drive element being capable of transitioning from the rod guide means to said guide track by bending from the axial direction of alignment with said drive rod to said angulated direction of said guide track of said head, said elongate flexible drive element also establishing connection with said movable jaw for application of both compression and tension force to said movable jaw.

3. The adjustable wrench mechanism of claim 1, wherein:

(a) said guide track and said substantially straight elongate internal passage define guide wall surfaces; and (b) said rigid drive segments being maintained in driving relation by said guide wall surfaces.

4. The adjustable wrench mechanism of claim 1, wherein:

(a) each of said rigid drive segments is of substantially spherical configuration; and (b) said elongate flexible drive cable establishes interconnection of said rigid drive segments and centering of said rigid drive segments with respect to one another.

5. The adjustable wrench mechanism of claim 1, wherein:

(a) each of said rigid drive segments is of plate-like configuration; and (b) said flexible drive cable extends centrally through each of said plate-like rigid drive segments to retain said drive segments in side-by-side compression transmitting engagement.

6. The adjustable wrench mechanism of claim 5, wherein:

each of said rigid plate-like drive segments defines a circular outer periphery of less thickness as compared to the thickness of the central portion thereof.

7. The adjustable wrench mechanism of claim 1, wherein:

(a) said substantially straight elongate internal passage is of non-circular cross-sectional configuration; and (b) said drive rod is nonrotatably received within said non-circular substantially straight elongate internal passage.

8. The adjustable wrench mechanism of claim 1, including:

a compression support being disposed within said head and being in registry with said guide track, said compression support being located for supporting engagement with said flexible drive extremity at said obtuse angle for support of compression loads being applied to that portion of said flexible drive extremity that is located beyond that obtuse angle due to positioning of said jaw.

9. The adjustable wrench mechanism of claim 1, wherein:

(a) said movable jaw defines a drive projection on said guide key portion thereof, said drive projection having a drive receptacle; and (b) one end of said elongate flexible drive element being received in driving engagement within said drive receptacle.

10. The adjustable wrench mechanism of claim 9, wherein:

said guide track defines a guide surface which retains said one end of said elongate flexible drive element in driving engagement within said drive receptacle.

11. An adjustable wrench mechanism, comprising:

(a) an elongate wrench body structure having a head at one end thereof to which is integrally connected an elongate handle and a fixed jaw, said fixed jaw having a flat working surface thereon, said head defining an internal passage therethrough forming a guide track, said elongate handle defining an elongate passage therethrough being disposed in intersecting relation with said guide track;

(b) a movable jaw having a guide key portion thereof being disposed in linearly movable relation with said jaw track, said movable jaw having a flat working surface thereon for cooperating with said flat working surface of said head to define spaced flat working surfaces for driving engagement with nut and bolt heads and other objects having opposed flat surfaces thereon;

(c) an elongate flexible jaw drive element being disposed in linearly movable guided relation within said elongate passage of said handle and having a driving extremity thereof disposed in driving engagement with said movable jaw for achieving positioning of said movable jaw relative to said fixed jaw of said head, said elongate jaw drive element having a plurality of rigid plate-like drive segments each defining an opening therethrough;

(d) a flexible drive cable extending through said openings of said rigid plate-like drive segments and retaining said rigid plate-like drive segments in side-by-side compression transmitting engagement;

(e) an elongate drive rod being received for linear movement within said elongate passage of said handle and defining forward and rear extremities, said forward extremity being connected to said flexible drive cable, said rear extremity of said elongate drive rod defining gear teeth;

(f) a work gear being rotatably supported by said handle and having the helical gear thereof disposed in driving interconnection with said gear teeth of said elongate jaw drive means, said work gear being manually actuatable for imparting forcible linear driving movement to said elongate jaw drive means and thus imparting adjusting and clamping movement of said movable jaw relative to said fixed jaw.

12. The adjustable wrench mechanism of claim 11, wherein:

said rigid plate-like drive segments of said elongate flexible drive segments each define a circular outer periphery of less thickness as compared to the central portion thereof.

13. The adjustable wrench mechanism of claim 11, wherein:

(a) said guide track and said guide means define guide wall surfaces; and (b) said rigid drive segments being maintained in driving relation by said guide wall surfaces.

14. The adjustable wrench mechanism of claim 11, wherein:

(a) said movable jaw defines a drive section on said guide key portion thereof, said drive section having a drive receptacle; and (b) one end of said elongate flexible drive element is received in driving engagement within said drive receptacle.

15. The adjustable wrench mechanism of claim 14, wherein:

said guide track defines a guide surface which retains said one end of said elongate flexible drive element in driving engagement within said drive receptacle.

* * * * *